United States Patent [19]

Owen

[11] 4,103,811

[45] Aug. 1, 1978

[54] ARTICLE CARRIER AND METHOD OF MAKING SAME

[75] Inventor: Ronald C. Owen, Harwood Heights, Ill.

[73] Assignee: Illinois Tool Works Inc., Chicago, Ill.

[21] Appl. No.: 622,049

[22] Filed: Oct. 14, 1975

Related U.S. Application Data

[62] Division of Ser. No. 360,081, May 14, 1973.

[51] Int. Cl.[2] ..... B65D 71/00

[52] U.S. Cl. ..... 224/45 AA; 206/150; 294/31.2

[58] Field of Search ..... 224/45 AA, 45 BA; 206/150, 805, 427, 162, 460; 229/28 R; 294/31.2, 87.2; 53/35

[56] References Cited

U.S. PATENT DOCUMENTS

| | | | |
|---|---|---|---|
| 1,999,909 | 4/1935 | Lupton | 229/28 R |
| 3,044,230 | 7/1962 | Fisher | 53/35 |
| 3,086,651 | 4/1963 | Poupitch | 206/150 |
| 3,186,544 | 6/1965 | Curry et al. | 206/162 |
| 3,785,484 | 1/1974 | Cunningham | 206/427 |
| 3,924,738 | 12/1975 | Poupitch | 206/150 |
| 3,938,656 | 2/1976 | Owen | 206/150 |

FOREIGN PATENT DOCUMENTS

| | | | |
|---|---|---|---|
| 1,132,912 | 11/1956 | France | 206/805 |

*Primary Examiner*—Trygve M. Blix
*Assistant Examiner*—Kenneth Noland
*Attorney, Agent, or Firm*—Olson, Trexler, Wolters, Bushnell & Fosse, Ltd.

[57] ABSTRACT

There is disclosed a carrier for a multiplicity of articles such as boxes, cans or other containers and comprising a flattened tube of plastic sheet material which is transversely slit partially therethrough at successive locations to present successive sections thereof to be unfolded to provide interconnected annular sections or rings for encircling the articles.

3 Claims, 8 Drawing Figures

Fig. 2
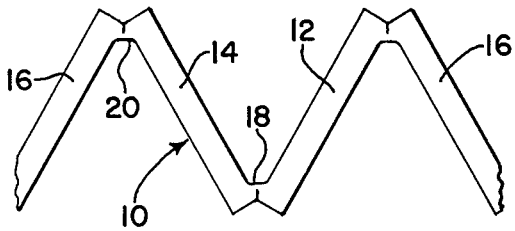
Fig. 1
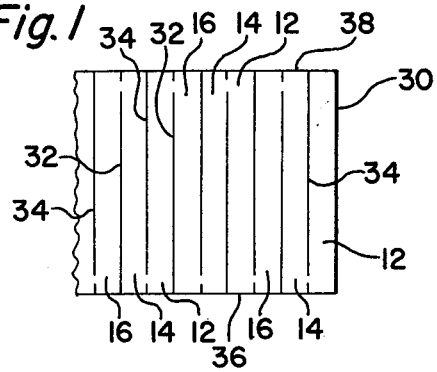
Fig. 3
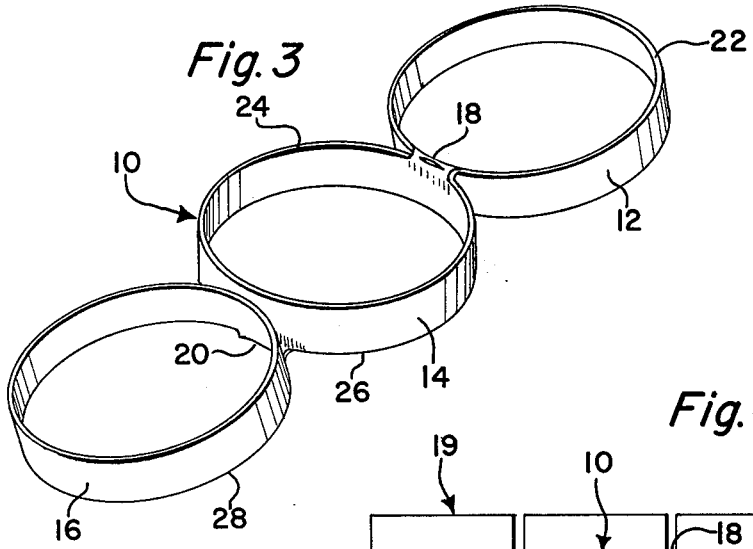
Fig. 4
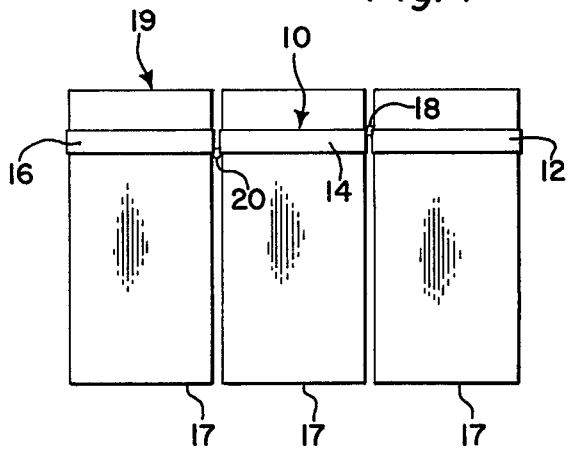
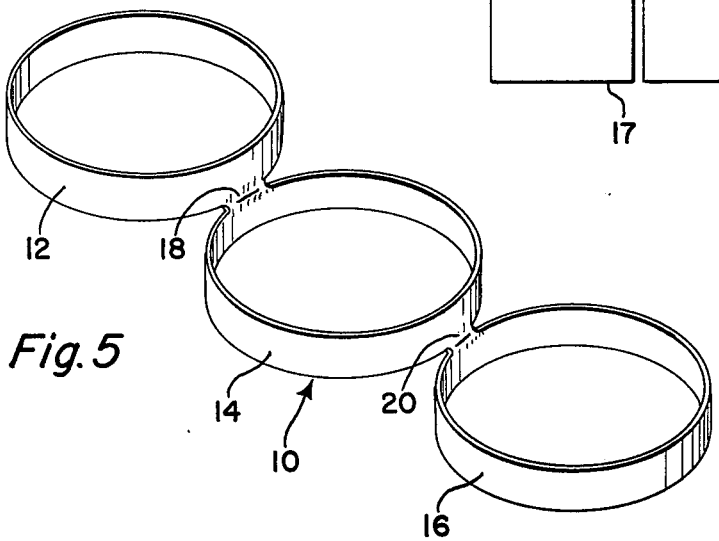
Fig. 5

ARTICLE CARRIER AND METHOD OF MAKING SAME

This is a Division, of application Ser. No. 360,081, filed: May 14, 1973.

The present invention relates to packaging of a plurality of articles such as boxes, cans, bottles and the like, and more specifically to a novel multiple article carrier and method of making the same.

An important object of the present invention is to provide a novel packaging device or carrier for a plurality of articles such as containers containing boxes, cans, bottles and the like, which carrier is of simple construction and is adapted to be easily and economically manufactured.

A more specific object of the present invention is to provide a novel packaging device or carrier which is of simple and efficient construction and may be easily and economically produced from a tube of sheet material.

Still another object of the present invention is to provide a novel method of producing a carrier of the above described type in an economical manner from a tube of suitable sheet material such as a tough resilient plastic material.

Other objects and advantages of the present invention will become apparent from the following description and accompanying drawings wherein:

FIG. 1 shows an elongated flattened tube of sheet material which is slit in accordance with an initial step of one form of the present invention to provide an elongated intermediate carrier blank;

FIG. 2 is a side elevational view showing the manner in which a carrier blank may be folded from the condition shown in FIG. 1 to the condition shown in FIG. 3 during preparation for assembly with a plurality of articles or containers;

FIG. 3 is a perspective view showing a carrier constructed in accordance with one embodiment of the present invention in condition ready for assembly with a plurality of articles or containers;

FIG. 4 is a side elevational view showing a package including the carrier of FIG. 3 assembled with a plurality of articles or containers;

FIG. 5 is a side elevational view similar to FIG. 3, but showing an alternative procedure for unfolding the carrier blank from the condition shown in FIG. 1;

Figure 6:
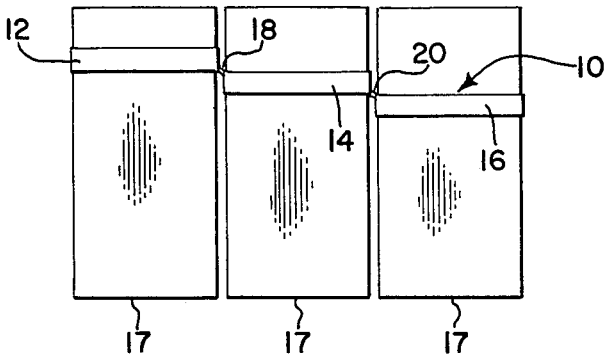
FIG. 6 is a side elevational view showing the carrier manipulated as in FIG. 5 assembled with a plurality of articles or containers.

Referring now more specifically to the drawings wherein like parts are designated by the same numeral throughout the various figures, a packaging device or carrier 10 incorporating features of the present invention is shown in FIGS. 2, 3 and 4. The carrier which is formed in accordance with the method described below is constructed from a tough sheet material, formed in the shape of a tube. Preferably, the carrier is produced from a resilient plastic material such as low density polyethylene.

In its final condition as shown in FIGS. 3 and 4, the carrier 10 includes a plurality of annular flexible and resilient container gripping sections 12, 14 and 16. While in the embodiment shown for the purpose of illustrating one form of the invention the carrier includes three of the article gripping sections, it is to be understood that a carrier having only two such sections or as many additional interconnected sections as desired may be provided.

Each of the article encircling sections, in its final form, has an axially extending wall with a height or axial length substantially greater than the thickness of the relatively thin plastic sheet material from which the carrier is made. As indicated in FIG. 3, each of the sections is initially of generally cylindrical configuration. However, it is to be understood that the flexible sections will readily adapt themselves to the configuration of the articles to which they are ultimately applied. Thus, when the carrier is applied to square or rectangular articles or containers 17 to provide a package 19 as is shown in FIG. 4, the ultimate configuration of the cylindrical sections 12, 14 and 16 will correspondingly be square or rectangular.

As shown best in FIG. 3, the adjacent sections of the carrier 10 are integrally interconnected at junction elements 18 and 20. It is to be noted that, in the form shown in FIG. 3, the junction 18 joins substantial circumferential segments of upper margins 22 and 24 of the sections 12 and 14 while junction 20 joins substantial circumferential segments of lower margins 26 and 28 of the sections 14 and 16. As a result, all of the sections 12, 14 and 16 are disposed in the final package so that they are substantially bisected by a common horizontal plane as shown in FIG. 4.

As indicated above, the carrier is preferably formed from thin tough resilient plastic material such as polyethylene. The inner circumference of each of the annular sections 12, 14 and 16 is slightly less than the circumference of the article 17. Thus, when the carrier is applied to the articles, the sections 12, 14 and 16 resiliently stretch so as to snugly and securely retain the articles. Depending on the particular plastic used from known polyethylene or other package materials, the carrier sections 12, 14 and 16 can be stretched up to about 25% of original circumference whereby the carrier is adapted to be applied securely to articles of different sizes. It is also noted that said sections 12, 14 and 16 are of cylindrical shape, the walls thereof will be substantially, uniformly stretched throughout their height or axial length to insure maximum positive grip on the articles. Of course when the carrier is applied to articles such as cans having radially projecting end seams or beads, the sections will stretch sufficiently to pass over the beads and then contract to grip the can bodies beneath the beads.

In FIGS. 5 and 6, the package and carrier identical to those shown in FIGS. 2–4 are shown except that the carrier blank is manipulated differently to position the successive sections 12, 14 and 16 in a stepped up arrangement. This is accomplished by manipulating the sections 12 and 16 by turning them inside out with respect to their original relationship to the intermediate section 14.

In accordance with a feature of the present invention, the carrier 10 may be easily and economically formed by starting with an elongated tube 30 of a suitable plastic sheet material as shown in FIG. 1 The tube may be initially formed as a seamless structure in accordance with known procedures or, if desired, it may be formed by joining margins of a sheet material strip by heat sealing or other means also in accordance with known procedures. In either event, the tube of sheet material is preferably flattened to the condition shown in FIG. 1 whereupon alternate slits 32 and 34 are cut in the flattened tube so that they extend respectively from tube margin 36 toward but short of tube margin 38 and from tube margin 38 toward but short of tube margin 36. These slits define the previously described sections 12, 14 and 16 of the final carrier interconnected at junctions 18 and 20. As shown in the drawings, the junctions 18 and 20 may be relieved for easier folding by short slits in the center portions of the junctions 18 and 20. As indicated by the repeated sets of reference numerals in FIG. 1, the tube 30 is initially formed in very long lengths so as to provide a multiplicity of interconnected carriers 10. The carriers 10 may subsequently be severed from each other either before or after assembly with articles or containers into packages such as the packages 19 and 31 shown in FIGS. 4 and 6. As will be understood, the alternate slits 32 and 34 may be readily formed by passing the tube between rollers carrying cutting knives of known construction, not shown.

Figure 7:
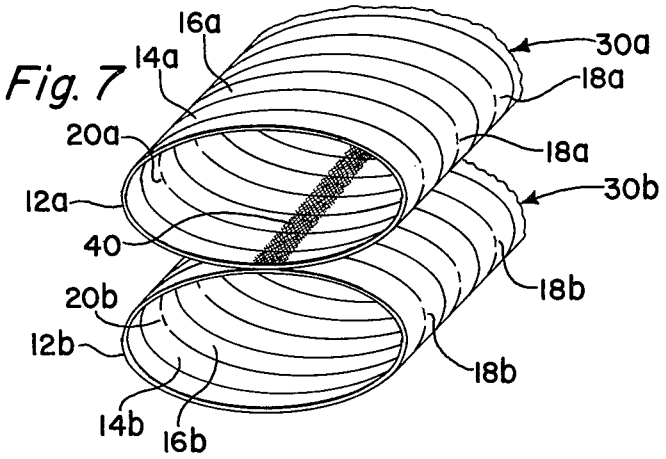
FIG. 7 is a perspective view showing a modified form of the present invention utilizing a plurality of interconnected tubes each of which is slit in essentially the same manner as the tube of FIG. 1.
Figure 8:
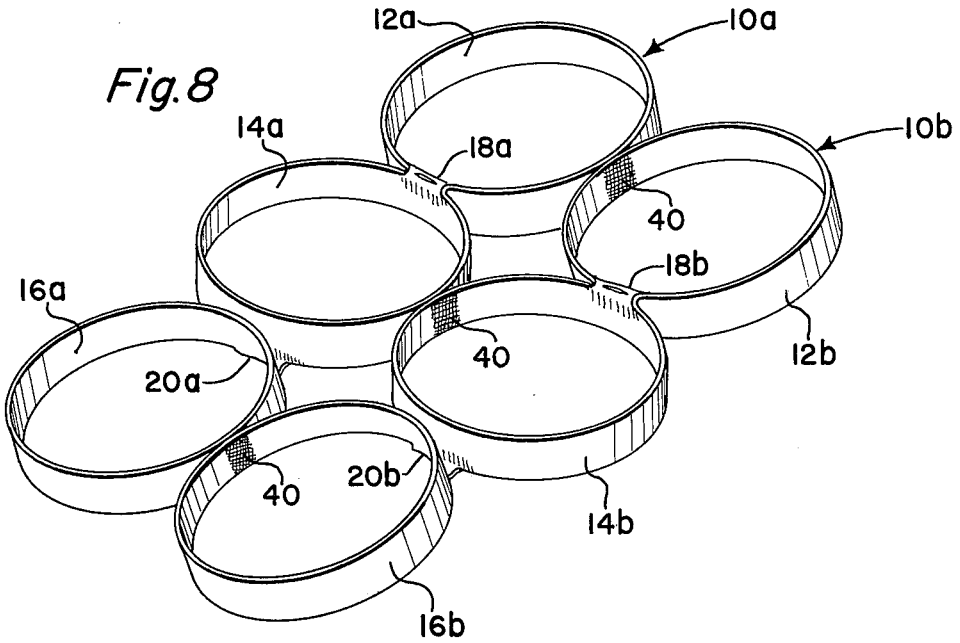
FIG. 8 is a perspective view showing the modified form of FIG. 7 in an unfolded condition ready for assembly with a plurality of articles or containers.

In FIGS. 7 and 8 there is shown a modified form of the present invention incorporating a pair of longitudinally integral or joined tubes 30*a* and 30*b* which are essentially identical to the tube 30 as indicated by the application of identical reference numerals with the suffixes a and b added to correspond elements. In this embodiment, the tubes 30*a* and 30*b* may be formed by heat sealing or otherwise joining separate tubes along a narrow longitudinally extending connecting section 40. Alternatively, a single large tube may be initially formed and narrow strips on opposite sides thereof may be heat sealed or otherwise secured together, to provide the connection section 40 and the individual longitudinally joined tubes. It is noted that both in the embodiment of FIGS. 7 and 8 and in the previously described structure of FIGS. 1–6, the tubes are slit so that the connecting elements or junctions 18 and 20 are located in the finished package at points directly between the adjacent articles of the package.

From the above description, it is seen that a novel article or container carrier has been provided which is of extremely simple economical and efficient construction. It is also seen that the carrier can be produced in accordance with the novel and simple method and in a manner so that the entire material of the initial blank or tube is used. In other words carriers may be produced in accordance with the present invention without any waste or scrap material.

While preferred embodiments of the present invention have been shown and described herein, it is obvious that many details may be changed without departing from the spirit and scope of the appended claims.

The invention is claimed as follows:

1. A carrier for a plurality of articles such as containers comprising a plurality of adjacently disposed annular sections of flexible expansible material for carrying articles each section having an upstanding wall having a height greater than its thickness but substantially less than its diameter and having upper and lower margins, and junction elements joining adjacent sections to each other along segments of their adjacent margins when said sections are unfolded in side-to-side relationship for carrying said articles, said sections including at least an intermediate section and additional sections adjacent thereto, said junction elements including a first junction element joining the upper margin of said intermediate section with a lower margin of one adjacent section and a second junction element joining a lower margin of the intermediate section with an upper margin of another of said adjacent sections whereby said junction elements provide for axial offset configuration of said sections.

2. A package comprising a plurality of juxtaposed articles such as containers and a carrier retaining said articles in the package, said carrier comprising a plurality of annular thin-walled sections, each of said sections having a height substantially greater than its thickness and encircling and gripping one of the articles, each of said sections presenting free upper and lower margins, and junction elements joining adjacent sections in the package to each other along segments of their adjacent margins disposed between adjacent articles in the package, each of said sections being axially offset with respect to an adjacent section to which it is joined so that juxtaposed articles in the package are spaced from each other only by a single thickness of the thin-walled sections.

3. A package, as defined in claim 2, wherein said annular sections include at least an intermediate section and additional sections adjacent thereto, said junction elements including a first junction element joining an upper margin of the intermediate section to a lower margin of one of said adjacent sections, said junction elements including a second junction element joining a lower margin of the intermediate section with an upper margin of another of said adjacent sections.

* * * * *